US008313391B2

(12) United States Patent
Roger et al.

(10) Patent No.: US 8,313,391 B2
(45) Date of Patent: Nov. 20, 2012

(54) FAIRING FOR A GOLF CLUB SHAFT

(75) Inventors: Gregory James Roger, Crows Nest (AU); David Gordon Hale, Lindfield (AU)

(73) Assignee: Advanced Surgical Design & Manufacture Limited, St. Leonards, New South Wales (AU)

( * ) Notice: Subject to any disclaimer, the term of this patent is extended or adjusted under 35 U.S.C. 154(b) by 83 days.

(21) Appl. No.: 12/743,958

(22) PCT Filed: Nov. 20, 2008

(86) PCT No.: PCT/AU2008/001720

§ 371 (c)(1),
(2), (4) Date: Aug. 31, 2010

(87) PCT Pub. No.: WO2009/065172

PCT Pub. Date: May 28, 2009

(65) Prior Publication Data

US 2011/0009208 A1 Jan. 13, 2011

(30) Foreign Application Priority Data

Nov. 20, 2007 (AU) ..... 2007906349

(51) Int. Cl.
*A63B 69/36* (2006.01)

(52) U.S. Cl. ..... 473/228; 473/223; 473/219

(58) Field of Classification Search ..... 473/219, 473/223, 228, 327

See application file for complete search history.

(56) References Cited

U.S. PATENT DOCUMENTS

| | | | | | |
|---|---|---|---|---|---|
| 1,396,470 | A | | 11/1921 | Taylor | |
| 2,088,095 | A | | 7/1937 | Sargent et al. | |
| 3,416,803 | A | * | 12/1968 | Batista | 473/228 |
| 3,565,444 | A | * | 2/1971 | La Rocca | 473/228 |
| 3,776,556 | A | | 12/1973 | McLaughlin | |
| 4,283,057 | A | | 8/1981 | Ragan | |
| 4,576,378 | A | * | 3/1986 | Backus | 473/228 |
| 4,953,868 | A | | 9/1990 | Thompson et al. | |
| 5,100,148 | A | * | 3/1992 | Smith | 473/228 |
| 5,165,683 | A | * | 11/1992 | Beutler et al. | 473/228 |
| 5,184,825 | A | * | 2/1993 | Ruth | 473/228 |

(Continued)

FOREIGN PATENT DOCUMENTS

GB 2387121 A 10/2003

OTHER PUBLICATIONS

The International Search Report and Written Opinion cited in International Application No. PCT/AU2007/000181, dated Apr. 20, 2007, 12 pages.

(Continued)

*Primary Examiner* — Raleigh W. Chiu
(74) *Attorney, Agent, or Firm* — Sterne, Kessler, Goldstein & Fox P.L.L.C.

(57) ABSTRACT

A golf club or implement comprising a grip region (14), a head (15), and a shaft (12) connecting the grip region (14) to the head (16). A fairing (20) is attachable to a trailing edge of the shaft (12). The fairing can reduce drag associated with the shaft (12) during a swing motion of the club or implement. The fairing can, on attachment, extend along a portion of the shaft (12) from a location proximal the head (16) of the club or implement.

31 Claims, 10 Drawing Sheets

U.S. PATENT DOCUMENTS

| | | | | |
|---|---|---|---|---|
| 5,310,188 | A * | 5/1994 | Hernberg | 473/206 |
| 5,335,918 | A * | 8/1994 | Rupnik et al. | 473/228 |
| 5,395,107 | A * | 3/1995 | De Pippo | 473/451 |
| 5,415,406 | A * | 5/1995 | Reichenbach et al. | 473/228 |
| 5,571,048 | A * | 11/1996 | Kenney | 473/228 |
| 5,575,725 | A | 11/1996 | Olsavsky | |
| 5,873,793 | A | 2/1999 | Swinford | |
| 5,913,733 | A | 6/1999 | Bamber | |
| 5,921,870 | A | 7/1999 | Chiasson | |
| 6,027,414 | A * | 2/2000 | Koebler | 473/228 |
| D441,043 | S * | 4/2001 | Barnette | D21/789 |
| 6,238,299 | B1 * | 5/2001 | Barnette | 473/228 |
| 6,409,612 | B1 | 6/2002 | Evans et al. | |
| 6,440,005 | B1 | 8/2002 | Hubenig | |
| 6,561,922 | B2 | 5/2003 | Bamber | |
| 6,881,156 | B1 * | 4/2005 | Phillips | 473/228 |
| 7,004,850 | B1 * | 2/2006 | Hong | 473/256 |
| 7,118,490 | B2 * | 10/2006 | Namba | 473/228 |
| D538,873 | S * | 3/2007 | Officer | D21/791 |
| 7,285,055 | B2 * | 10/2007 | Radle | 473/228 |
| 7,497,785 | B2 * | 3/2009 | Koncelik, Jr. | 473/228 |
| 7,780,542 | B1 * | 8/2010 | Ross et al. | 473/226 |
| 7,951,013 | B1 * | 5/2011 | Snyder et al. | 473/228 |
| 2001/0055994 | A1 | 12/2001 | Kwitek | |
| 2002/0072432 | A1 | 6/2002 | Hirata | |
| 2003/0207719 | A1 * | 11/2003 | Hughes | 473/228 |
| 2005/0215339 | A1 * | 9/2005 | Namba | 473/228 |
| 2006/0014588 | A1 * | 1/2006 | Page | 473/228 |
| 2006/0040759 | A1 * | 2/2006 | Radle | 473/228 |
| 2006/0264263 | A1 * | 11/2006 | Williams | 473/223 |
| 2007/0129159 | A1 * | 6/2007 | Koncelik | 473/226 |
| 2011/0218048 | A1 * | 9/2011 | Snyder et al. | 473/228 |
| 2012/0021847 | A1 * | 1/2012 | Kim | 473/219 |

OTHER PUBLICATIONS

The International Search Report and Written Opinion cited in International Application No. PCT/AU2008/001720, dated Feb. 3, 2009, 17 pages.

* cited by examiner

FAIRING FOR A GOLF CLUB SHAFT

CROSS-REFERENCE TO RELATED APPLICATIONS

The present application claims priority from Australian Provisional Patent Application No 2007906349 filed on 20 Nov. 2007, the content of which is incorporated herein by reference.

FIELD OF THE APPLICATION

The present application relates in part to implements, tools or sporting items, for example a golf club, that must move be moved during a typical use. In one embodiment, the application describes an arrangement that has the potential to increase the stability and speed of an implement, tool of sporting item as it is moved during use. Again, for example, in the case of a golf club, the arrangement can be suitable to provide an increase in the stability and club head speed of a golf club during a golf swing. The present application also describes a device for training a golf swing, and for applying remedial measures for use during practice and also for providing feedback during the swing to the player and the player's coach.

BACKGROUND ART

By way of example only, some background will firstly be provided by some comments concerning the game of golf. Golf is a popular pastime of both sexes and is played by people of all ages and abilities.

Golf is played with golf clubs of various types. Golf clubs generally come in three forms: woods, irons and putters which are distinguished by the shape of the club and the intended use of the club. While commonly referred to as "woods", it will be appreciated that such clubs are now typically fabricated from a metal or metal alloy. Woods and irons are generally used to bit the ball desired distances in the air with spin and/or loft, while putters are generally used to impart rolling motion to the ball as it travels across a green adjacent the hole.

For woods and irons in particular, the clubs are typically swung at speed to contact the ball, making the ball airborne in a direction towards a desired target. In this regard, much emphasis has been placed on developing and manufacturing woods and irons in a manner that provides the golfer with increased control over the length of their drive and the direction of the ball following impact. Generally, most advances have been focussed on increasing the size of the club head and/or optimising the weight distribution of the club. It will be appreciated that most existing clubs still comprise a hand grip, tubular shaft and head.

For woods, in particular driving woods, club head speed has been considered as being important in obtaining relatively long driving distances. As most conventional drivers have a club head with a substantially flat face to contact the ball that is located on the end of a tubular shaft, swinging of the club at speed will generate aerodynamic drag which can greatly reduce the speed and/or stability of the club head during a golf swing. Such drag can be particularly detrimental to golfers who are learning the game and/or developing their swing technique, as well as those looking to optimise their game.

The design and manufacture of golf clubs is also a highly regulated field and is governed by laws set by the game authorities. The proportions of the club head are controlled by the rules of golf. The design of the golf club shaft is also controlled. For example, it is understood that the shaft of a golf club cannot have a greater stiffness in any plane as compared to the other. This is, at least in part, to prevent stability being built into the club shaft in a fore/aft plane while still allowing "whip" during the swing. In short, the club shaft must be homogeneous in its stiffness in all planes.

While the above background has concentrated on golf clubs, it will be appreciated that golf clubs are just one example of an implement, sporting or otherwise, that during use may need to be moved through air.

Any discussion of documents, acts, materials, devices, articles or the like which has been included in the present specification is solely for the purpose of providing a context for the present application. It is not to be taken as an admission that any or all of these matters form part of the prior art base or were common general knowledge in the field relevant to the present application as it existed before the priority date of each claim of this application.

SUMMARY

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

According to a first aspect, the present application is directed to a fairing for a golf club or other implement having a grip region and which is moved in use, the fairing being attachable to the shaft of the golf club or implement to reduce drag associated with said shaft during a swing motion of the club or movement of the device, wherein on attachment the fairing extends along a portion of the shaft from a location proximal an end of the club or implement that is distal the grip region where the club or device is normally held.

According to a second aspect, the present application is directed to a golf club or implement comprising:

a grip region;

a head;

a shaft connecting the grip region to the head; and a fairing attachable to the shaft to reduce drag associated with said shaft during a swing motion of the club or implement, wherein on attachment the fairing extends along a portion of the shaft from a location proximal the head of the club or implement.

According to another aspect, the present application is a golf club or implement comprising:

a grip region;

a head;

a shaft connecting the grip region to the head; and a drag reduction means attachable to the shaft to reduce drag associated with said shaft during a swing motion of the club or implement, wherein on attachment the drag reduction means extends along a portion of the shaft from a location proximal the head of the club or implement.

In this aspect, the drag reductions means can comprise a fairing, such as the fairing defined herein with respect to other aspects.

In one embodiment the fairing can be non-removably attachable to the shaft, for example the trailing edge of the shaft. In this embodiment, the fairing and the shaft can form a substantially continuous surface.

In another embodiment, the fairing can be removably attachable to the shaft, for example, the trailing edge of the shaft.

In a further embodiment, the fairing can be attachable to the shaft adjacent the head. It can extend along the shaft away from the head for a length less than half, more preferably less than a third, of the length of the shaft. In one embodiment, the fairing can extend along the shaft from the head for a length of between about 5 cm and 60 cm, for example between 10 cm and 50 cm, or between about 10 cm and 30 cm, or for about 20 cm along the shaft, for example the trailing edge thereof.

In yet another embodiment, the fairing can have a maximum thickness that is substantially the same as, or slightly less than, the diameter of the shaft. This width will be dependent on the nature of the implement. For example, in the case of a golf club, at its maximum, the width can be between about 5 mm and 20 mm, for example about or less than 15 mm. At least a portion of the fairing can also be shaped such that it conforms to the trailing edge of the shaft. In a still further embodiment, the fairing can be spaced from the shaft. In one example, the spacing can be between about 5 mm and 30 mm, for example about 20 mm. The spacing having this value can be between a lower end of the fairing that is relatively closest to the head and the shaft.

In one embodiment, the thickness of the fairing of the fairing can decrease away from the shaft. This decrease in thickness can be uniform or non-uniform over some or all of the width of the fairing.

In one embodiment and in the case of a golf club, the width of the fairing can be such that the lower end of the fairing extends backwardly from the shaft a distance greater than the width of the head of the club. The lower end could extend backwardly for a distance that is the same than or less than one of the dimensions, for example, the width, length or height, of the head.

The fairing can decrease in width from its lower end to its upper end that is positioned distal the head. In one embodiment, the width can taper over some or all of the length of the fairing. Still further, the taper can be substantially linear or linear from the lower end to the upper end. In another embodiment, the fairing can increase in width from its lower end to the upper end. Again, the width can taper over some or all of the length of the fairing. As above, this taper can be substantially linear or linear from the lower end to the upper end.

In a still further embodiment, the fairing can be attachable to the shaft, for example, by way of one or more swivel mechanisms, such that it can move relative to the shaft. In the case of a golf club, and during the swing motion of the club, the fairing can be free to move relative to the shaft. In this regard, during the swing motion, the angle of incidence of the fairing to the direction of motion may vary. Such variation may act to provide optimal drag relief throughout the swing motion.

The fairing can be movable relative to the shaft such that it can be oriented between various desired positions. Once in a desired position the fairing can then be maintained or locked in that position and stay there during use of the club or implement and/or it is desired to adjust the position of the fairing. In this embodiment, one or more swivel mechanisms can be provided that allow the fairing to be moved relative to the shaft but then locked in position. In another mechanism, attachment of the fairing to the shaft can be such that the fairing can only undergo a change in orientation by being firstly removed from the shaft and then reattached in a different orientation. The fairing can adopt two or more orientations relative to the shaft.

In an embodiment, the attachment of the fairing can be made in a way that it does not substantially alter the stiffness of the shaft. The fairing can be attached to the shaft at a number of spaced locations. The locations can be equidistant apart or non-equidistant apart. The attachments can comprise circumferential members that loop around and/or through the shaft and also through or in another way connected to the fairing. The attachments can comprise circumferential or non-circumferential members. In one embodiment, the attachments can comprise peg members embedded or otherwise connected to the shaft with the fairing attached to a portion of the peg members extending outwardly from the shaft.

The attachments, such as the circumferential members, non-circumferential members or the peg members, can be relatively thin compared to the dimensions of the fairing and/or shaft so as to ensure to the properties of these members does not significantly modify the overall stiffness of the club shaft. The attachments can also be formed and/or positioned so as to ensure the fairing does not substantially resist any bending action of the shaft as it is swung and, for example, strikes a ball. In another embodiment, the fairing may be filleted to allow it to bend, at least partially, as much as the shaft during a swing of that shaft.

In one embodiment, the attachments can be removable from the fairing and/or shaft. A set of attachments can be used to attach different fairings to a shaft. For example, where a player is training or is a beginner, that player may gradually progress from using one size or type of fairing mounted or attached to the shaft to a different size or type of fairing. The attachments can be used to allow attachment of the different types of fairing.

In yet another embodiment, the fairing can have a curved body. The fairing can be curved relative to a lateral plane and/or a longitudinal plane.

In another embodiment, the fairing can have a first face and a second face with one or both of these faces being curved. The curvature of the first and second faces can be both convex and terminate in a distal edge or the fairing can be truncated.

In another embodiment, the curvature of the first face can be convex. In this case, the second face can be flat, concave or convex. When the second face is convex, the first face can be flat, concave or convex. In this embodiment, the distances between the first and second faces can remain constant for some, the majority or all of the width of the fairing. In another embodiment, the distance between the first convex face and second concave face can decrease toward an edge of the fairing distal the shaft.

Some or all of the curvature of the curved body, the first face (if curved) and/or the second face (if curved) can be substantially circular or circular, substantially elliptical or elliptical, substantially parabolic or parabolic or substantially hyperbolic or hyperbolic. In one embodiment, the curvature can be substantially non-circular in cross-section. In one form, the body may be in the form of an aerofoil and be wing or blade-shaped in cross section. In another embodiment, the body may be substantially oval or oval, substantially elliptical or elliptical or tear-drop-shaped in cross section. Other suitable cross-sectional shapes can be used.

Still further, the cross-sectional shape of the fairing may vary over the height of the fairing. For example, the cross-sectional shape in say the upper half of the fairing may be different to that in the lower half of the fairing.

Some or all of the body of the fairing may be made from a relatively lightweight material. As an example only, the body may be made at least in part from carbon-fibre, a plastics material, or wood, or combinations thereof.

In a still further embodiment, the body of the fairing may also have one or more of holes, orifices or indentations provided therein which generate a sound as air passes therethrough or thereover. The sound, which can be a whistling sound, can be used to provide feedback to the individual user of the club or implement or to a person training the user (e.g. a trainer or coach) regarding the motion of the club or implement during the swing. Other whistling devices or whistling means mounted to the fairing and/or the club head can also be envisaged and utilised for the same purpose as described herein.

Feedback provided by the whistling means can be used by the individual or their trainer/coach to adjust the fairing angle with respect to the shaft to suit the needs of the individual. In this regard, the whistling means, if used, may be formed through the fairing at angles which generate different notes indicative of the motion of the club during the stroke, with different notes indicating different angles of malrotation. Upon optimising the position of the fairing in accordance with this system, a permanent fairing can be attached to the shaft of the individual's clubs or implement in accordance with what has been determined to be the optimal orientation.

It will be appreciated that a player may be able to use a club or implement that is only used during practice, in the case of a golf club, for example, at a golf driving range. While the club or implement would incorporate one, some or all of the features disclosed herein, it would be appreciated that the club or implement would only likely be used in practice as it would likely be not compliant with the rule of the relevant sport, e.g. the Rules of Golf. Instead, this practice club or implement would be used to strengthen, guide and develop the swing of the user. In particular, a training club could be used with the guidance and assistance of a coach or Golf Professional to allow modification of the settings and adjustments made possible using one, some or all of the features described herein to improve the golfers swing, ball strike and enjoyment.

A golf club incorporating one, some or all of the features disclosed herein can also be modified to suit the progress being made by a player in developing their golf swing.

The shaft can have a region of greater cross-sectional width or diameter relative to the remainder of the shaft. The greater region can vary, for example taper, in size. For example, the shaft region can be frusto-conical. The greater region may uniformly increase in diameter over its length or non-uniformly increase in diameter over its length. In addition or instead, the region may comprise a series of stepped portions in which the diameter increases, for example frusto-conically, is then constant, reduces or steps outwardly to a greater diameter, and then again increases in diameter, for example, in the manner described herein. The diameter of said region can increase moving along the shaft away from the grip region. Alternatively, the diameter of said region can decrease moving along the shaft away from the grip region. The increase in diameter towards the grip region of said greater region can be at a rate that substantially matches or deliberately mismatches the change in shaft speed that occurs during a swing of the club or implement, it being understood that the velocity of the shaft closer to the grip region is lower than that closer to the head during a swing.

Said region of greater cross-sectional width or diameter can be in the half of the shaft that is closer to the grip region, in the half of the shaft closer to the club head, or at least partially span the half way mark between the grip region and the head.

The diameter of the shaft of the club or implement can be such that the shaft during its swing reaches separation velocity before striking the ball. At separation velocity, i.e. the velocity at which the airflow separates from the shaft, drag is at least partially reduced.

According to another aspect, the present application is directed to a golf club or implement comprising:

a grip region;

a head; and a shaft connecting the grip region to the head;

wherein the shaft has a region of greater cross-sectional width or diameter relative to the remainder of the shaft.

In this aspect, the greater region can vary, for example taper, in size. For example, the greater region can be frusto-conical. The greater region may uniformly increase in diameter over its length or non-uniformly increase in diameter over its length. The region may comprise a series of stepped portions in which the diameter increases, for example frusto-conically, is then constant, reduces or steps outwardly to a greater diameter, and then again increases in diameter in the manner described herein. The diameter of said region can increase moving along the shaft away from the grip region. The diameter of said region can decrease moving along the shaft away from the grip region. The increase in diameter towards the grip region of said greater region can be at a rate that substantially matches or deliberately mismatches the change in shaft speed that occurs during a swing of the golfer, it being understood that the velocity of the shaft closer to the grip region is lower than that closer to the head during a swing.

Said greater region can be in the half of the shaft closer to the grip region, in the half of the shaft closer to the club head, or at least partially span the half way mark between the grip region and the head.

The golf club or implement of this aspect can further incorporate one, some or all of the other features described herein.

In yet another embodiment of all of the aspects defined herein, a portion, a majority or all of the shaft can be substantially circular or circular in cross-section. In another embodiment, a portion, a majority or all of the shaft can be substantially non-circular in cross-section. In one form, a portion, a majority or all of the shaft may be in the form of an aerofoil and be wing or blade-shaped in cross section. In another embodiment, a portion, a majority or all of the shaft may be substantially oval or oval, substantially elliptical or elliptical or tear-drop-shaped in cross section.

In another embodiment, the shaft can have a leading edge, a trailing edge, and a first face and an opposed second face extending between the leading edge and the trailing edge. A portion or all of the first and/or second faces of the shaft can be curved. Where curved, the curvature of the first and second faces can be both convex.

In another embodiment, the curvature of the first face of the shaft (where curved) can be convex. In this case, the second face of the shaft can be flat, concave or convex. When the curvature of the second face of the shaft is convex, the first face can be flat, concave or convex. Where the first face is convex and the second face is concave (or vice versa), the distances between the first and second faces of the shaft can remain constant for some, the majority or all of the width of the shaft. In another embodiment, the distance between the first convex face and second concave face (or vice versa) can decrease toward one or both of the leading edge and trailing edge of the shaft.

Some or all of the curvature of the first face (if curved) and/or the second face (if curved) of the shaft can be substantially circular or circular, substantially elliptical or elliptical, substantially parabolic or parabolic or substantially hyperbolic or hyperbolic. In one embodiment, the curvature can be substantially non-circular in cross-section.

Other suitable cross-sectional shapes for the shaft can be envisaged. Irrespective of its cross-section, the shaft can be equal in flexibility in all planes. This can be achieved by use of different combinations of materials and/or materials with varying properties in forming the shaft.

According to another aspect, the present application is directed to a golf club or implement comprising:

a grip region;

a head; and a shaft connecting the grip region to the head;

wherein a portion, a majority or all of the shaft has a non-circular cross-sectional area.

In this aspect, the shaft can have an aerofoil form. The shaft can be substantially wing-shaped or blade-shaped in cross section.

In another embodiment of this aspect, a portion, a majority or all of the shaft may be substantially oval or oval, substantially elliptical or elliptical or tear-drop-shaped in cross section.

In another embodiment of this aspect, the shaft can have a leading edge, a trailing edge, and a first face and an opposed second face extending between the leading edge and the trailing edge. A portion or all of the first and/or second faces of the shaft can be curved. Where curved, the curvature of the first and second faces can be both convex.

In another embodiment of this aspect, the curvature of the first face of the shaft (where curved) can be convex. In this case, the second face of the shaft can be flat, concave or convex. When the curvature of the second face of the shaft is convex, the first face can be flat, concave or convex. Where the first face is convex and the second face is concave, the distances between the first and second faces of the shaft can remain constant for some, the majority or all of the width of the shaft. In another embodiment, the distance between the first convex face and the second concave face can decrease toward one or both of the leading edge and trailing edge of the shaft.

Some or all of the curvature of the first face (if curved) and/or the second face (if curved) of the shaft can be substantially circular or circular, substantially elliptical or elliptical, substantially parabolic or parabolic or substantially hyperbolic or hyperbolic. In one embodiment, the curvature can be substantially non-circular in cross-section.

Irrespective of its cross-section, the shaft can be equal in flexibility in all planes. This can be achieved by use of different combinations of materials and/or materials with varying properties in forming the shaft.

The golf club or implement of this aspect can further incorporate one, some or all of the other features described herein.

In yet another embodiment of the aspects defined herein, at least a portion, the majority or all of the shaft and/or the head and/or the fairing can have a surface treatment that modifies the airflow over the region of surface treatment. The surface treatment can comprise a dimpling formed in the surface of said portion of said shaft, head or fairing. A portion of the shaft extending back from the head towards the grip region can have the surface treatment. Instead or in addition, the surface treatment can be provided on at least some or all of the leading edge of the shaft. In yet a further embodiment, the surface treatment, such as the dimpling, can be the same over said portion or can vary over said portion. In yet another embodiment, more than one type of surface treatment, with one example being dimpling, can be provided with different types of surface treatment can be present at different locations on the shaft, head or fairing. The dimpling can comprise a plurality of dimples formed in said portion or all of the shaft, head or fairing. Some or all of the plurality of dimples can be provided in an array on said portion. Alternatively, some or all of the plurality of dimples can be provided randomly on said portion. Each of the dimples can be identical or at least some of the dimples can be different to some of the other dimples. Each dimple can have a depth and diameter. All of the dimples can have the same depth and/or diameter or at least some or all of the dimples can have a different depth and/or diameter to at least one of the other dimples. The dimples can have a circular on non-circular perimeter. The diameter of the dimples can range from between about 0.5 mm and 10 mm, more preferably between about 1 mm and 7 mm. The maximum depth of the dimples can vary between about 0.1 mm and 10 mm, more preferably between about 1 mm and 4 mm.

According to another aspect, the present application is directed to a golf club or implement comprising:

a grip region;

a head; and a shaft connecting the grip region to the head;

wherein at least a portion of the shaft has a surface treatment that modifies the airflow over at least that part of the shaft.

In this aspect, the surface treatment can comprise a dimpling formed in the surface of said portion of said shaft. A portion of the shaft extending back from the head towards the grip region can have the surface treatment. Instead or in addition, the surface treatment can be provided on at least some or all of the leading edge of the shaft. In yet a further embodiment, the surface treatment, such as the dimpling, can be the same over said portion or can vary over said portion. In yet another embodiment, more than one type of surface treatment, with one example being dimpling, can be provided with different types of surface treatment can be present at different locations on the shaft. The dimpling can comprise a plurality of dimples formed in said portion or all of the shaft. Some or all of the plurality of dimples can be provided in an array on said portion. Alternatively, some or all of the plurality of dimples can be provided randomly on said portion. Each of the dimples can be identical or at least some of the dimples can be different to some of the other dimples. Each dimple can have a depth and diameter. All of the dimples can have the same depth and/or diameter or at least some or all of the dimples can have a different depth and/or diameter to at least one of the other dimples. The dimples can have a circular on non-circular perimeter. The diameter of the dimples can range from between about 0.5 mm and 10 mm, more preferably between about 1 mm and 7 mm. The maximum depth of the dimples can vary between about 0.1 mm and 10 mm, more preferably between about 1 mm and 4 mm.

The golf club or implement of this aspect can further incorporate one, some or all of the other features described herein. Where the club or implement includes a fairing, at least a portion, the majority or all of said fairing can also have said surface treatment as defined herein. At least a portion, the majority or all of the head of the club or implement can also have said surface treatment as defined herein.

In each of the aspects defined herein, the characteristics of the club or implement can be optimised to match the characteristics of a player's swing determined by appropriate analysis. In this regard, different clubs or implements may have a different indicia, for example a colour coding, that identifies the type of player or player swing to which a particular club or implement combination is suited.

In a further embodiment of all of the aspects defined herein, the head can be formed such that the upper surface of the head provides an airflow path that is shorter than the lower surface of the head. In one embodiment, the head can have a lateral cross-section that is substantially like an inverted aircraft wing. The shape of the head when moved through air can thereby create a positive air pressure on the upper surface of the head and a lower pressure on the underside of the head. In this arrangement, and in the case of a golf club, as the head approaches the ground during a swing of the club and immediately prior to contact with the ball, the club head is drawn towards the ground, thereby stabilising the club immediately prior to and during the contact stage of the swing. It will be appreciated that other means to reduce the ground effect of the club could be employed. Such means may include providing furrows, holes or orifices or using other surface treatments in the surface of the head to alter the air flow characteristics of the head during the swing stroke.

According to another aspect, the present application is directed to a golf club or implement comprising:

a grip region;

a head having an upper surface and a lower surface; and a shaft connecting the grip region to the head;

wherein the upper surface of the head provides at least one airflow path that is relatively shorter than at least one airflow path over the tower surface of the head.

In this aspect, the head can have a lateral cross-section that resembles an inverted aircraft wing, thereby creating a positive air pressure on the upper surface of the head and a lower pressure on the underside of the club head during swinging of the head. In this arrangement, and in the case of a golf club, as the head approaches the ground during a swing of the club and immediately prior to contact with the ball, the club head is drawn towards the ground, thereby stabilising the club immediately prior to and during the contact stage of the swing. It will be appreciated that other means to reduce the ground effect of the club could be employed. Such means may include providing furrows, holes or orifices or using other surface treatments in the surface of the head to alter the air flow characteristics of the head during the swing stroke.

The golf club of this aspect can further incorporate one, some or all of the other features described herein.

In a further embodiment of the aspects defined herein, a relatively heavy material, such as a relatively heavy metal can be used within or mountable on the club head. In one embodiment, the relatively heavy material can be palladium. The presence of this relatively heavy material can serve to increase the momentum of any given club head during its swing. This relatively heavy material may also be positioned eccentrically to counter some natural defect in the individual's swing or ball strike. In one embodiment, a golfer can use a practice club which provides for adjustable positioning of the relatively heavy material so allowing a determination of the final desired position for the material in a game club.

According to another aspect, the present application is directed to a golf club or implement comprising:

a grip region;

a head having an upper surface and a lower surface; and a shaft connecting the grip region to the head;

wherein the club head has mounted thereon or incorporates a quantity of a relatively heavy material.

In one embodiment, the relatively heavy material has a mass greater than material making up the remainder of the head. The relatively heavy material can be a metal. The metal can be palladium. The relatively heavy metal may also be positioned eccentrically within the head to counter some natural defect in the individual's swing or ball strike. In one embodiment, a golfer can use a practice club which provides for adjustable positioning of the relatively heavy material so allowing a determination of the final desired position for the material in a game club.

The golf club of this aspect can further incorporate one, some or all of the other features described herein.

In a still further embodiment of the aspects defined herein, some, the majority or all of the grip region of the club or implement is formed, at least in part, from a fluid that undergoes a relatively rapid increase in viscosity with applied strain rate, i.e. is non-Newtonian in form. As such, the grip region can be moulded to the palms and fingers of the golfer by use of a relatively slow gripping action but then maintain that moulded shape during the relatively fast swing and strike phases of use of the club or implement. The non-Newtonian fluid can be a liquid or gel and be contained within one or more outer layers.

According to another aspect, the present application is directed to a golf club or implement comprising:

a grip region;

a head having an upper surface and a lower surface; and a shaft connecting the grip region to the head;

wherein some, the majority or all of the grip region of the club is formed, at least in part, from a fluid that undergoes a relatively rapid increase in viscosity with applied strain rate.

In this aspect, the grip region can comprise a material that is known as non-Newtonian. As such, the grip region can be moulded to the palms and fingers of the golfer by use of a relatively slow gripping action but then maintain that moulded shape during the relatively fast swing and strike phases of use of the club or implement. The non-Newtonian fluid can be a liquid or gel and be contained within one or more outer layers.

The golf club of this aspect can further incorporate one, some or all of the other features described herein.

Whilst the above embodiments have been described in particular application to a golf club or implement, it will be appreciated that they could equally be applied to a variety of sporting and non-sporting endeavours whereby an implement having a shaft is swung or moved by a user at speed. In this regard, the implement can be a paddle or oar used in canoes, kayaks, and rowing boats, such as single and double sculls, to reduce turbulence associated therewith. The implement could also be a baseball bat, a cricket bat, a tennis racquet, a table tennis bat, and other such sporting equipment where control and speed of the equipment is fundamental in optimising sporting performance. The implement can also comprise a tool, such as a hammer.

BRIEF DESCRIPTION OF THE DRAWINGS

By way of example only, embodiments are now described with reference to the accompanying drawings, in which.

DETAILED DESCRIPTION OF AN EXEMPLARY EMBODIMENT

Figure 1A:
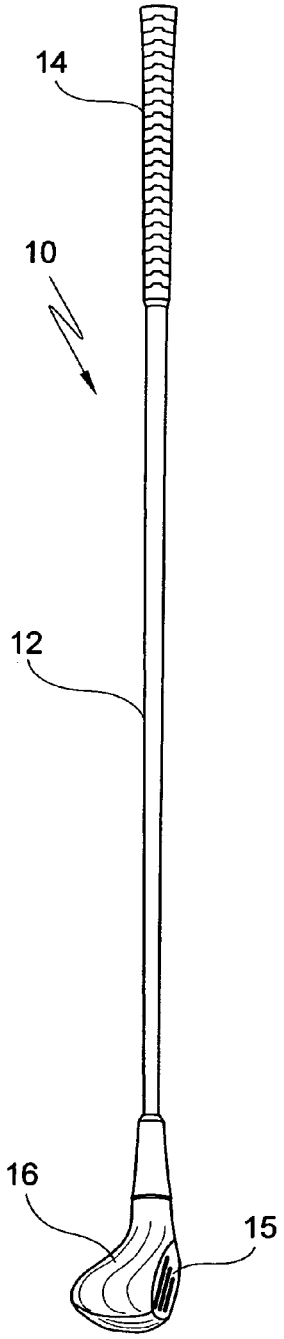
FIGS. 1A, 1B and 1C are side, top and front views of a prior art golf club.
Figure 1B:
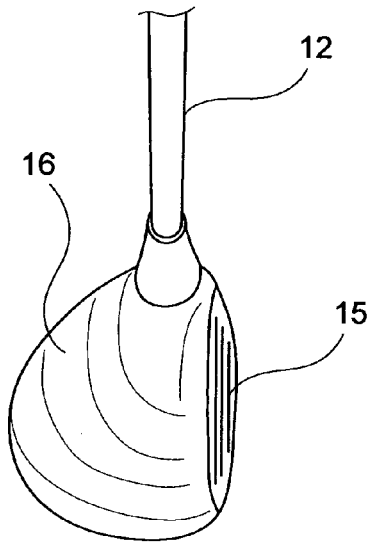
Figure 1C:
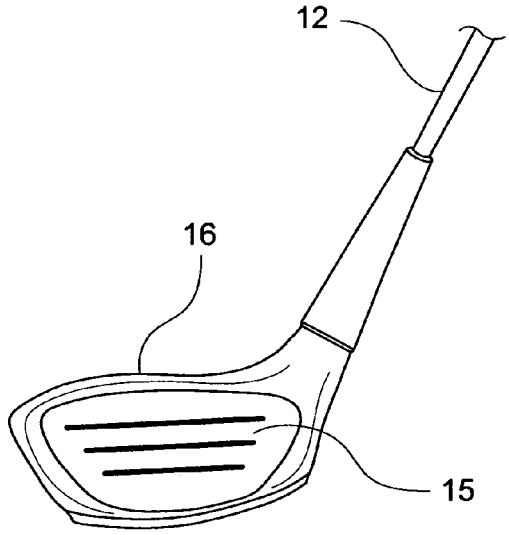
Fig.1c PRIOR ART

Referring to FIGS. 1A-1C, various views of one type of prior art golf club 10 are shown. In the depicted drawings and description, the club 10 will be described in terms of a wood, such as a driving wood. It is, however, to be appreciated that this description is equally applicable to all types of golf clubs and also other implements that are moved through air during typical use.

As is shown in FIG. 1A, the club 10 generally consists of three parts: the shaft 12, the grip region 14 and the head 16. A hosel joins the head 16 to the shaft 12.

The grip region 14 is located at the end of the shaft 12 that is distal the club head 16 and is typically covered with either a rubber or synthetic leather for the golfer to hold and grip region the club 10. The shaft 12 is typically a tube made of metal (e.g. steel) or graphite fibre, or a combination thereof, which is roughly 10-12 mm in diameter near the grip region 14 and between 89-115 cm in length. The flex of the shaft 12, namely the amount in which the shaft will bend when placed under load, can vary between different clubs and is typically dependent upon the preference of the individual golfer as to the desired degree of flex they desire. Generally, golfers with faster swing speeds use stiffer shafts than those with slower swing speeds. Generally, the shaft 12 transfers motion to the club head 16 and this is considered fundamental in generating club head speed.

The head 16 is located at the end of the shaft 12 and transfers the energy of the swing to the golf ball. The head 16 comprises a generally flat face 15 for contacting the ball during the swing, and it is the slope of the face 15 away from the vertical which typically dictates the amount of loft that is given, to the trajectory of the ball following contact.

The design and proportions of the various parts of the golf club 10 are controlled by the rules of golf and players should use clubs in accordance with the rules if they wish their scores to count in competition, professional or otherwise.

In practice, the club is held by the golfer using both hands at the grip region 14 and swing in a downward arc such that the face 15 of the head 16 is brought into contact with a golf ball to send the ball on its trajectory. In this regard, whilst the head 16 of the club 10 generates the most speed during the swing and transfers the energy of the swing to the ball, the shaft 12, particularly the region of the shaft 12 proximal the head 16, also moves at a relatively high speed through the air.

Figure 2:
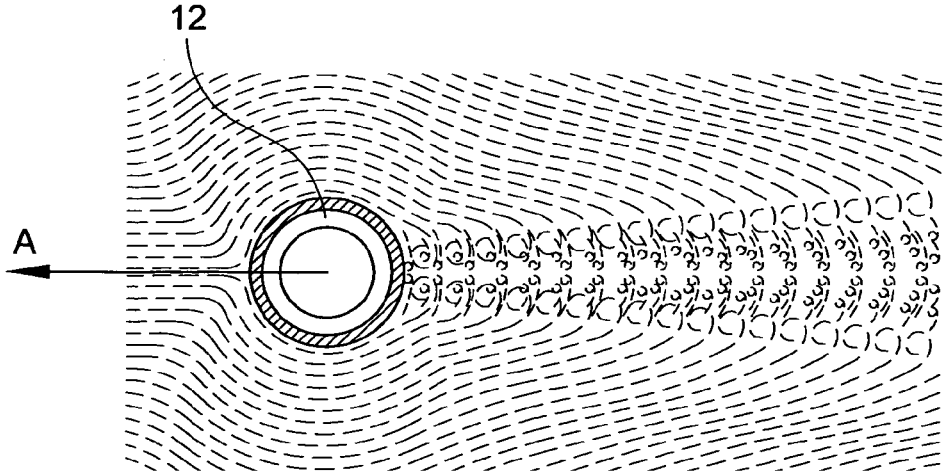
FIG. 2 depicts the air flow characteristics of a cylinder, such as a traditional shaft of a golf club.

As a standard golf club shaft 12 is tubular, it has inherently relatively poor aerodynamic properties, as can be seen in FIG. 2. As the shaft 12 moves through the air during the swing stroke, in the direction of arrow A, the air smoothly flows over the leading surface of the shaft 12, closely hugging the surface. As the air flows past the first half of the shaft surface it breaks free of the surface creating a plurality of tiny vortex flows, called vortices. This region of separated or turbulent flow is a form of pressure drag, namely the formation of low and high pressure pockets leave a wake behind the shaft 12 during the stroke. This drag is a force that opposes forward motion of the shaft 12 thereby reducing club head speed and stability of the club 10 during the swing stroke. All of this serves to potentially compromise controlled trajectory of the ball following impact.

Figure 3:
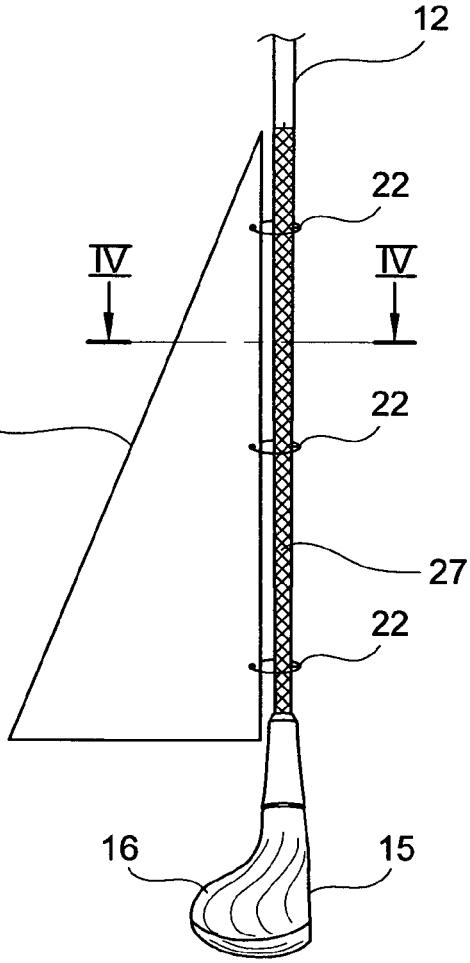
FIG. 3 depicts one embodiment of a fairing shown attached to a golf club.
Figure 4:
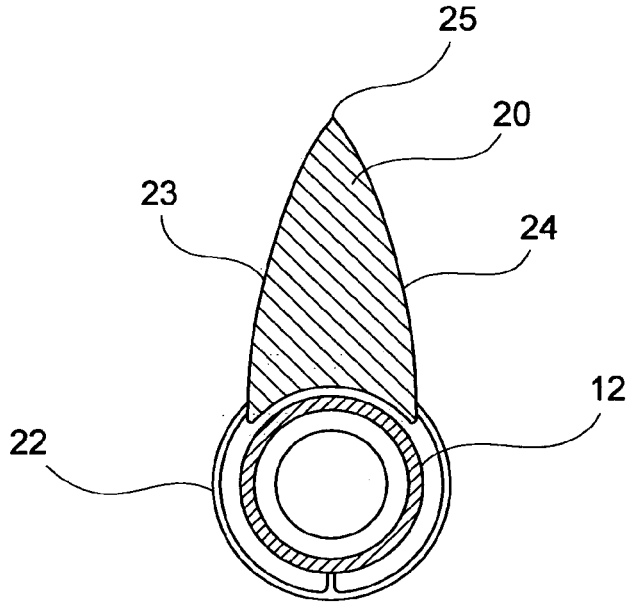
FIG. 4 is a cross-sectional view of the fairing attached to the shaft of FIG. 3.

In FIGS. 3 and 4, one embodiment of a fairing is labelled 20 and is depicted attached to what can be considered the trailing edge of the shaft 12 of a golf club. Here the trailing edge is the edge of the shaft that is opposed to the travel of the swing of the club as it brought into contact with the ball. The depicted fairing 20 acts a drug reduction means and serves to reduce drag and to improve stability of the club 10 and increase club head 16 speed during at least the downward stroke or swing of the club 10. The depicted fairing 20 has a relatively aerodynamic configuration. The embodiment depicted in FIG. 4 has a non-circular cross-section and has two opposed curved faces 23, 24 that join at an edge 25 distal the shaft 12. The fairing 20 can serve to reduce turbulence and increase laminar flow in the region of the shaft 12.

The fairing can have other possible shapes. For example, the fairing can have a curved body. The body can have a curvature relative to a lateral place and/or a curvature relative to a longitudinal plane.

Figure 12A:
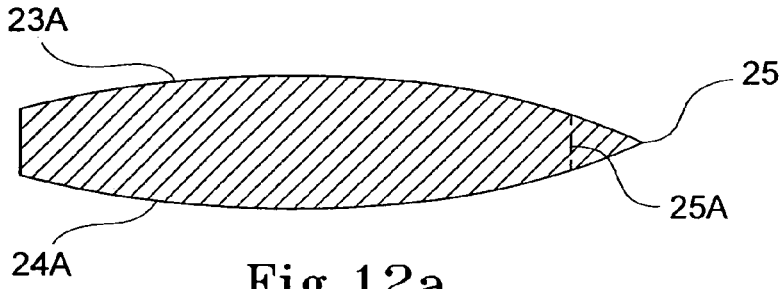
FIGS. 12*a* to 12*e* depict cross-sectional views of different embodiments of fairings (or shafts).
Figure 12B:
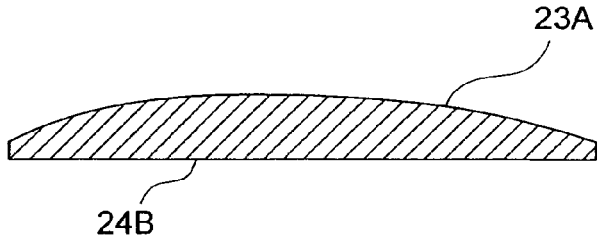

Examples of different possible cross-sectional shapes for the fairing in a lateral plane are provided by FIGS. 12*a* to 12*e*. In each of these embodiments, the fairing can also have a first face (here 23*a*) and a second face (24*a*, 24*b* or 24*c*). As depicted, one or both of these faces being curved. For example and as depicted in FIG. 12*a*, the curvature of the first and second faces (23*a*, 24*a*) can be both convex. While the two faces 23*a*, 24*a* join at distal edge 25, the edge could instead be truncated (as depicted by line 25*a*).

Figure 12C:
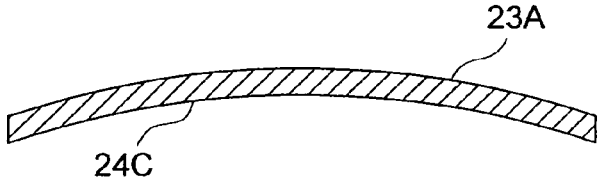
Figure 12D:
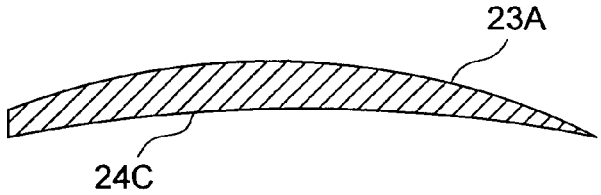
Figure 12E:
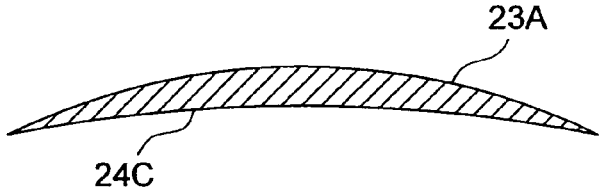

While the curvature of the first face 23*a* can be convex, the second face can be flat (see face 24*b* in FIG. 12*b*) or concave (see face 24*c* in FIGS. 12*c*, 12*d* and 12*e*).

When the second face 24*c* is concave, it will be appreciated that the first face can be flat, concave or convex.

In FIG. 12*c*, the distance between the first and second faces (23*a*, 24*c*) remains constant. In FIGS. 12*d* and 12*e*, the distance between the first convex face 23*a* and second concave face 24*c* decreases toward the distal edge 25.

Some or all of the curvature of the curved body, the first face (if curved) and/or the second face (if curved) can be substantially circular or circular, substantially elliptical or elliptical, substantially parabolic or parabolic or substantially hyperbolic or hyperbolic. In one embodiment, the curvature can be substantially non-circular in cross-section. In one form, the body of the fairing may be in the form of an aerofoil and be wing or blade-shaped in cross section. In another embodiment, the body may be substantially oval or oval, substantially elliptical or elliptical or tear-drop-shaped in cross section. Other suitable cross-sectional shapes can be used.

Still further, the cross-sectional shape of the fairing may vary over the height of the fairing. For example, the cross-sectional shape in say the upper half of the fairing may be different to that in the lower half of the fairing.

In the embodiment depicted in FIG. 3, the fairing 20 is attached to the shaft 12 adjacent the head 16 such that it extends along the shaft for a length less than half, more preferably less than a third of the length of the shaft 12. In one embodiment, the fairing can extend along the shaft 12 from the head 16 for a length of between about 5 cm and 60 cm, for example between about 10 cm and 50 cm or between about 10 cm and 30 cm, or about 20 cm, along the trailing edge thereof. Other dimensions, and as given herein, can be used.

As shown in FIG. 4, the fairing 20 can have a maximum thickness that is substantially the same as, or slightly less than, the diameter of the shaft 12 and be shaped such that it substantially conforms to the trailing edge of the shaft 12. For example, if the shaft has a diameter of about 15 mm, the maximum thickness can be about or less than 15 mm. As depicted in FIG. 3, the fairing 20 can also be spaced from the shaft 12. In the depicted embodiment, the spacing can be anywhere between 5 mm and 30 mm, for example about 20 mm at its lowest point adjacent the head 16.

As depicted, the width of the fairing 20 can be such that the lower end of the fairing 20 extends backwardly from the shaft 12 a distance greater than the width of the head 16 of the club 10. It will be appreciated that the lower end could extend backwardly for a distance that is the same than or less than the width of the head 16.

The fairing 20 may be made from a lightweight material such as carbon fibre, plastic or wood, or combinations thereof.

The fairing 20 can be secured to the shaft 12 in a manner which does not significantly alter the stiffness of the shaft 12, thereby ensuring that the club meets the regulatory requirements set by the appropriate governing bodies. In this regard, the depicted fairing 20 is attached to the shaft at intervals along its length by a series of circumferential members 22 which extend about, and are affixed to, the circumference of the shaft 12. The fairing 20 is attached to each of the members 22 in a manner which ensures the fairing 20 does not substantially resist the bending action of the shaft 12 during the swinging motion. In this regard, the fairing 20 may be attached to the members 22 by way of a slide member to facilitate such movement of the fairing 20 between the members 22. To further ensure that the fairing 20 is able to bend with the shaft 12, the fairing 20 may also be filleted. While the members 22 are circumferential, non-circumferential members could be used.

The orientation of the fairing 20 to the club shaft 12 and head 16 may be adjustable to suit the swing motion of each individual golfer. In this regard, during a normal swinging motion, the angle of incidence of the fairing to the direction of motion may vary, becoming optimally aligned as the club rotates at the lower end of the swing prior to striking the ball. The fairing 20 may be attached by means of a swivel to continually provide optimal drag relief throughout the swing motion.

Figure 7:
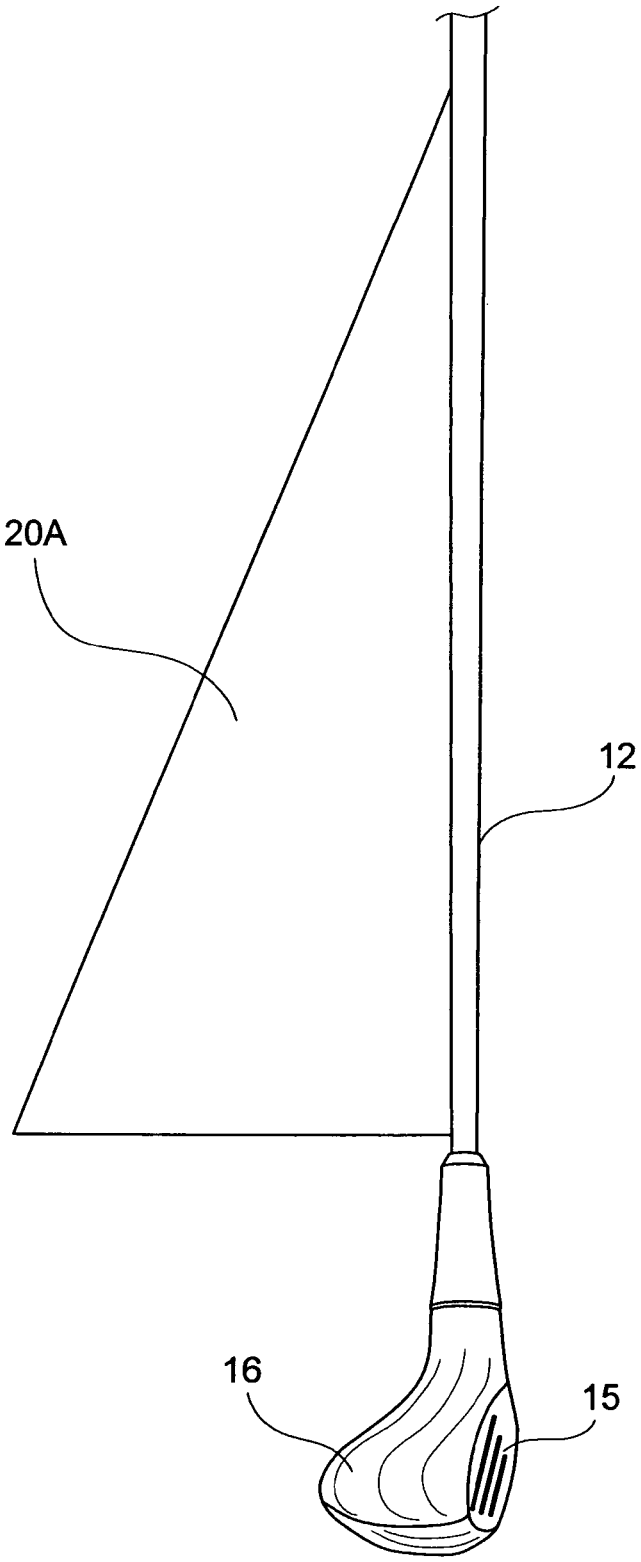
FIG. 7 depicts another embodiment of a golf club with a fairing non-removably mounted thereto.

In another embodiment, the fairing 20 may be fixedly orientated in relation to the shaft 12 to satisfy the rules of golf that prevent modification of a club 10 during the course of a game of golf. In a still further embodiment, and as depicted in FIG. 7, the fairing 20 can be non-movably attachable to the club or even comprise an integral part of the shaft 12.

The manner in which the fairing 20 is attached to the shaft 12 can vary. In one embodiment the fairing 20 may be fixed to the shaft by way of an adhesive or the like such that the fairing 20 forms part of the shaft 12 and is contoured to the diameter of the shaft 12 such that the surface of the shaft 12 and fairing 20 is substantially or wholly continuous.

Figure 5:
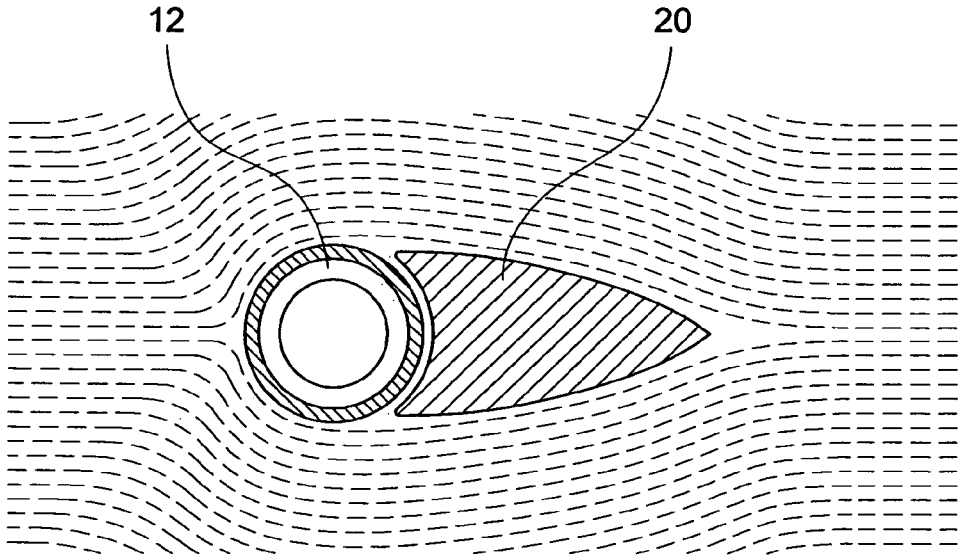
FIG. 5 depicts the air flow characteristics of the shaft and fairing combination of FIG. 3.

As is shown in FIG. 5, the fairing 20 can serve to relatively increase laminar flow (flow in layers) over the shaft 12 such that the airflow stays relatively more attached to the surface of the fairing 20, thereby significantly reducing the creation of vortices. This is in stark contrast to the arrangement as discussed above in relation to FIG. 2.

The above described arrangement is particularly applicable for use in practice and training exercises. In this regard, the fairing 20 can, at least in one arrangement, be readily attachable to the end portion of a shaft 12 of any golf club and its angle orientated to suit the swing of the individual golfer. The fairing 20 may also have one or more holes or orifices or other whistling means provided therein which generate a sound as air passes therethrough or thereover. The sound, typically in the form of a whistle, provides feedback to the user regarding the motion of the club 10 during the stroke. This can be used by the individual or their club professional to optimally adjust the fairing 20 angle with respect to the shaft to suit the needs of the individual and/or inform the user of their club professional what they need to change about their swing to improve. In this regard, the holes may be formed through the fairing 20 at angles which generate different notes indicative of the motion of the club during the stroke, with different notes indicating different angles of malrotation. Upon optimising the position of the fairing 20 in accordance with this system, a permanent fairing 20 (for example, as depicted in FIG. 7) can be attached to the shaft of the individual's clubs in accordance to the optimal orientation.

It will be appreciated that existing club heads 16, such as that shown in FIGS. 1A to 1C, are substantially aerodynamically efficient. As such, in combination with fairing 20 attached to the shaft adjacent the head 16, the lower end of the club, which moves at high speed has significantly improved aerodynamic characteristics, whilst the remainder of the club is substantially unchanged. Such an arrangement provides a club 10 which optimises club head speed at impact and which stabilises the swing motion of the club 10 resulting in greater ball control and greater ball carry than is currently obtainable with existing golf clubs.

Figure 6:
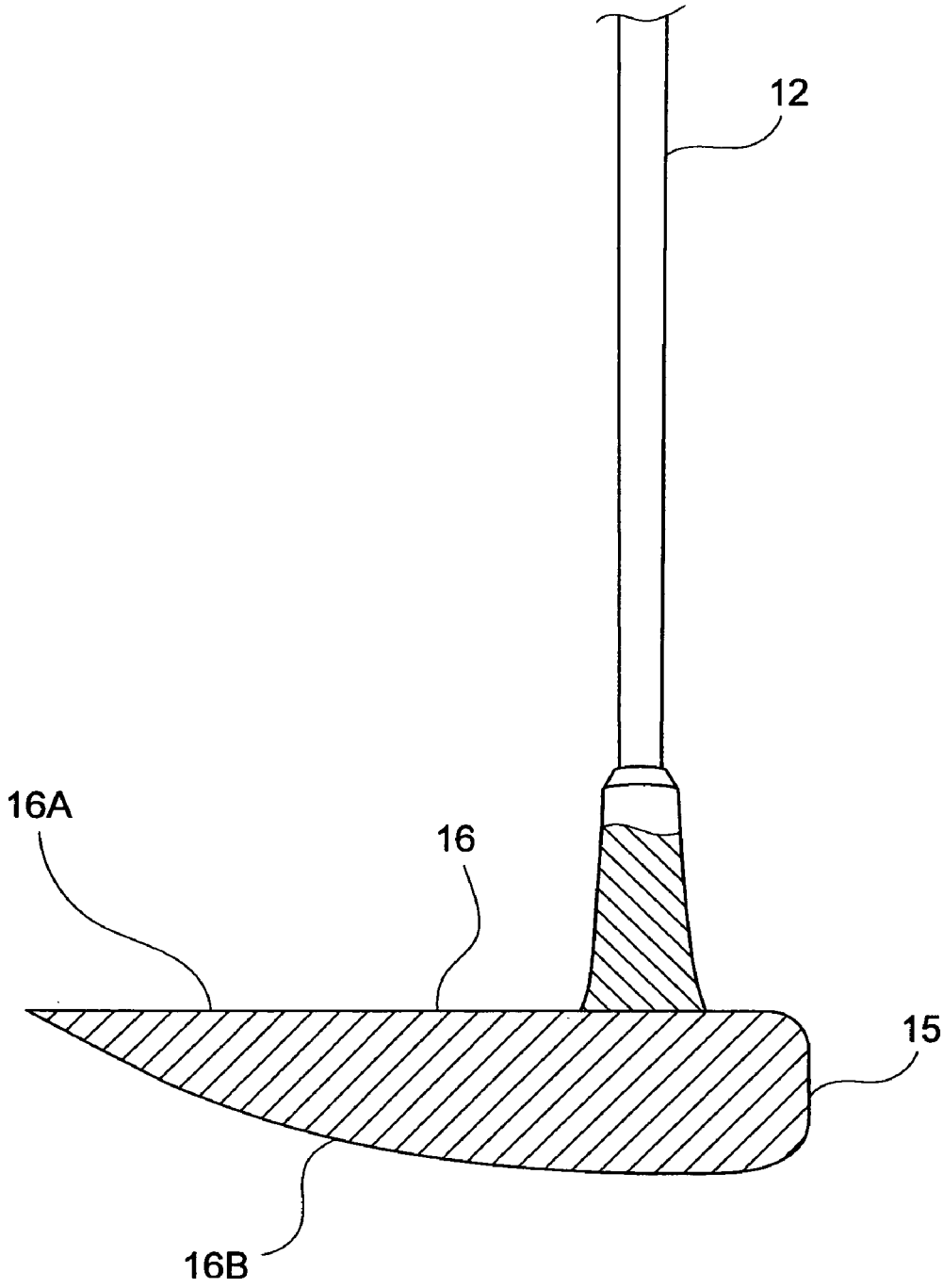
FIG. 6 is a cross-sectional view of a golf club head and shaft portion in accordance with another embodiment.

Whilst, as discussed above, existing golf heads 16 provide a relatively even aerodynamic performance, this can be a potential disadvantage as it generates a buffer of air beneath the club as the head 16 approaches the ground. This can cause instability in the motion of the head in the swing path resulting as the head 16 travels along this air buffer. In order to reduce this air buffer, the club head 16 can have a cross-sectional shape as shown in FIG. 6.

In this arrangement the upper surface 16*a* of the head 16 provides an airflow path which allows air to easily pass along the surface thereof whilst the lower surface 16*b* of the head 16 provides a relatively longer surface for the air to pass over. The shape of the head 16 in part resembles an inverted aircraft wing. The shape serves to create a positive air pressure on the upper surface of the head 16 and a lower pressure on the underside of the club head 16. In this arrangement, as the head 16 approaches the ground, immediately prior to contact with the ball, the club head 16 is drawn or sucked towards the ground, thereby stabilising the club immediately prior to and during the contact stage of the swing. It will be appreciated that other means to reduce the ground effect of the club could be employed. Such means may include providing furrows, holes or a surface treatment in or on the surface of the head 16 to alter the air flow characteristics of the head 16 during the swing stroke.

Figure 8:
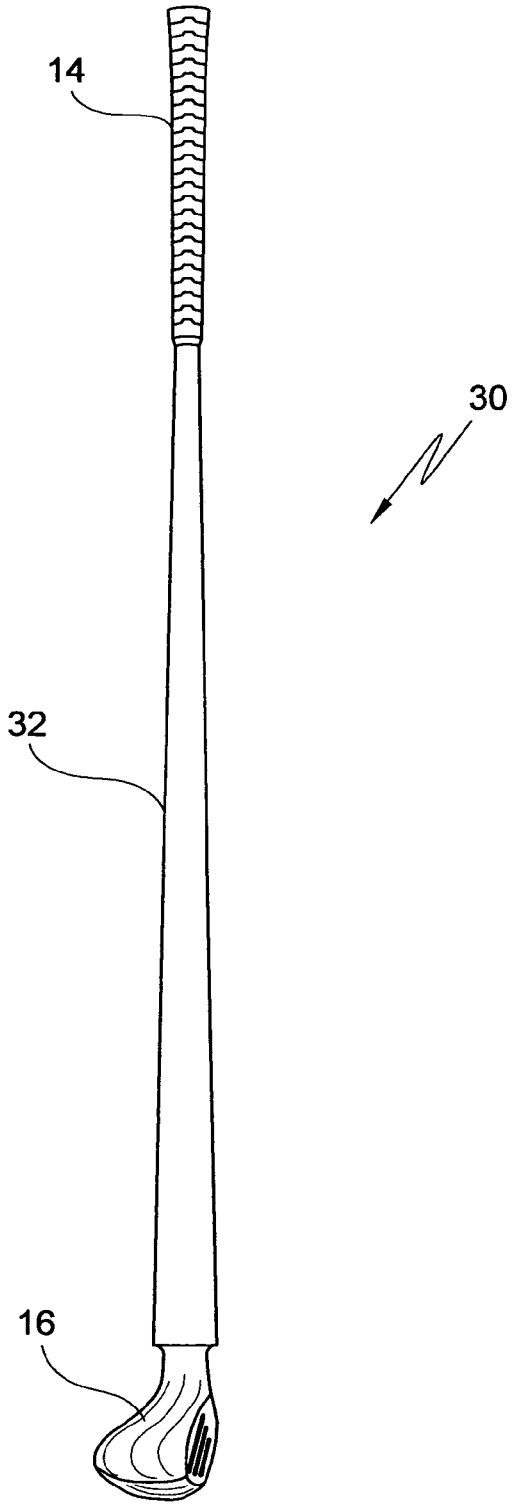
FIG. 8 depicts an embodiment of a golf club having a shaft that increases in diameter away from the grip region towards the head.

In FIG. 8, one example of another club arrangement is depicted generally as 30. Here, the club 30 has a grip region 14, a shaft 32 and a head 16. The shaft 32 has a diameter that increases away from the grip region 14. It will be noted that the shaft 32 is depicted as being frusto-conical. In other embodiments, the increase may be non-uniform over its length. It could also comprise a series of stepped portions in which the diameter increases, for example frusto-conically, is then constant, reduces or steps outwardly to a greater diameter, and then again increases in diameter in the manner described herein.

Figure 9:
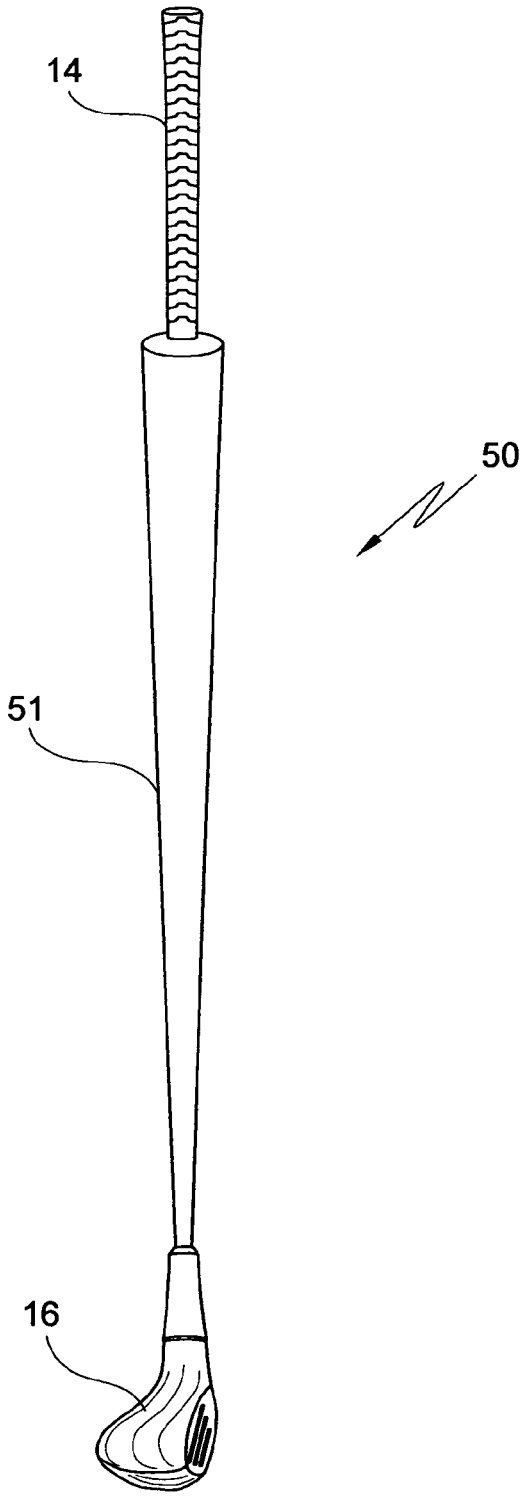
FIG. 9 depicts an embodiment of a golf club having a shaft that increases in diameter towards the grip region away from the head.

As depicted in FIG. 9, a different example of a club arrangement is depicted generally as 50. Here, the club again has a grip region 14 and a head 16 but is provided with a frusto-conical shaft 51 where the diameter of the shaft decreases moving along the shaft away from the grip region 14. While FIG. 9 depicts a frusto-conical shaft 51, the change in diameter can be non-uniform or comprise a series of stepped portions in which the diameter decreases away from the grip region 14, for example frusto-conically, is then constant, reduces or steps inwardly to a lesser diameter, and then again decreases in diameter in the manner described herein. The increase in diameter towards the grip region 14 can be at a rate that substantially matches or deliberately mismatches the change in shaft speed that occurs during a swing of the golfer, it being understood that the velocity of the shaft closer to the grip region 14 is lower than that closer to the head 16 during a swing.

As depicted in FIG. 8 and FIG. 9, the frusto-conical region of the shaft can extend over the entire length of the shaft between the grip region 14 and the head 16. In another embodiment, it will be appreciated that the frusto-conical region could be provided in the half of the shaft that is closer to the grip region 14, or in the half of the shaft closer to the club head 16, or it could at least partially span the half way mark between the grip region 14 and the head 16.

Turning back to the embodiment depicted in FIGS. 4 and 5, a portion, a majority, or all of the shaft can be substantially circular or circular in cross-section. In another embodiment, a portion, a majority or all of the shaft can be substantially non-circular in cross-section. While FIGS. 12*a* to 12*e* depict examples of possible cross-sectional shapes of the fairing as defined herein, the shaft of the club or implement can also have a cross-sectional shape as depicted in FIGS. 12*a* to 12*e*. The shaft can have a cross-sectional shape in the form of an aerofoil and/or be wing or blade-shaped in cross section (i.e. it can have as an example one of the cross-sectional shapes depicted by FIGS. 12 to 12*e*). Other cross-sectional shapes can be envisaged, such as substantially oval or oval, substantially elliptical or tear-drop-shaped in cross section. Irrespective of its cross-section, the shaft 12 can be equal in flexibility in all planes. This can be achieved by use of different combinations of materials and/or materials with varying properties in forming the shaft 12.

At least some or all of the shaft 12, 32, 51 can also have a surface treatment that modifies the airflow over the part of the shaft 12, 32, 51 that has the surface treatment. In one embodiment, the surface treatment can comprise a dimpling formed in the surface of said portion of said shaft 12, 32, 51. In one embodiment, a portion of the shaft 12, 32, 51 extending back from the head 16 towards the grip region 14 can have the surface treatment. As an example of this location, the cross-hatched region 27 present on the shaft 12 adjacent the head 16 has a surface treatment in the form of a dimpling in the surface. The surface treatment could be provided on other areas of the shaft, and on a portion, the majority or all of the head and/or on a portion, the majority or all of the fairing. For example, the surface treatment can be provided on at least some or all of the leading edge of the types of shaft 12, 32, 51. In another embodiment, more than one type of surface treatment can be provided with different types of surface treatment being present at different locations on the shaft 12, 32, 51, head 16 and/or fairing.

The dimpling can comprise a plurality of dimples formed in said portion or all of the shaft, head and/or fairing. Some or all of the plurality of dimples can be provided in an array on said portion. Alternatively, some or all of the plurality of dimples can be provided randomly on said portion. Each of the dimples can be identical or at least some of the dimples can be different to some of the other dimples. Each dimple can have a depth and diameter. All of the dimples can have the same depth and/or diameter or at least some or all of the dimples can have a different depth and/or diameter to at least one of the other dimples. The dimples can have a circular on non-circular perimeter. The diameter of the dimples can range from between about 0.5 mm and 10 mm, more preferably between about 1 mm and 7 mm. The maximum depth of the dimples can vary between about 0.1 mm and 10 mm, more preferably between about 1 mm and 4 mm.

The striking face of known club heads are hollowed, to allow a trampoline style of face with which to strike the ball. This loss of material means that a higher terminal velocity is required to maintain the momentum, which is in turn transferred to the ball as it is struck. Making a larger club head can overcome this, however, there are penalties in terms of drag and also the rules of golf limit the dimensions of the club head, as well as the proportion of those dimensions.

In a further embodiment, a relatively heavy material, such as a relatively heavy metal (e.g. palladium) can be used within the club head, for example, the club head 16 depicted in FIG. 3. The presence of this relatively heavy material serves to increase the momentum of any given club head. This relatively heavy material may also be positioned eccentrically to counter some natural defect in the players swing or ball strike. For example, the relatively heavy material may be positioned relatively closer to the face 15 of the head 16 than the rear of the club head 16. Instead or on addition, the relatively heavy material may be positioned closer to the upper surface of the head 16 than the lower surface. In one embodiment, a golfer can use a practice club which provides for adjustable positioning of the relatively heavy material so allowing a determination of the final desired position for the material in a game club.

In a further embodiment, some, the majority or all of the grip region (for example, the grip region 14 of the club 30 depicted in FIG. 8) of the club is formed, at least in part, from a fluid that undergoes a relatively rapid increase in viscosity with applied strain rate, i.e. is non-Newtonian. As such, the grip region 14 can be moulded to the palms and fingers of the golfer by use of a relatively slow gripping action but then maintain that moulded shape during the relatively fast swing and strike phases of use of the club. The non-Newtonian fluid can be a liquid or gel and be contained within one or more outer layers.

Figure 10A:
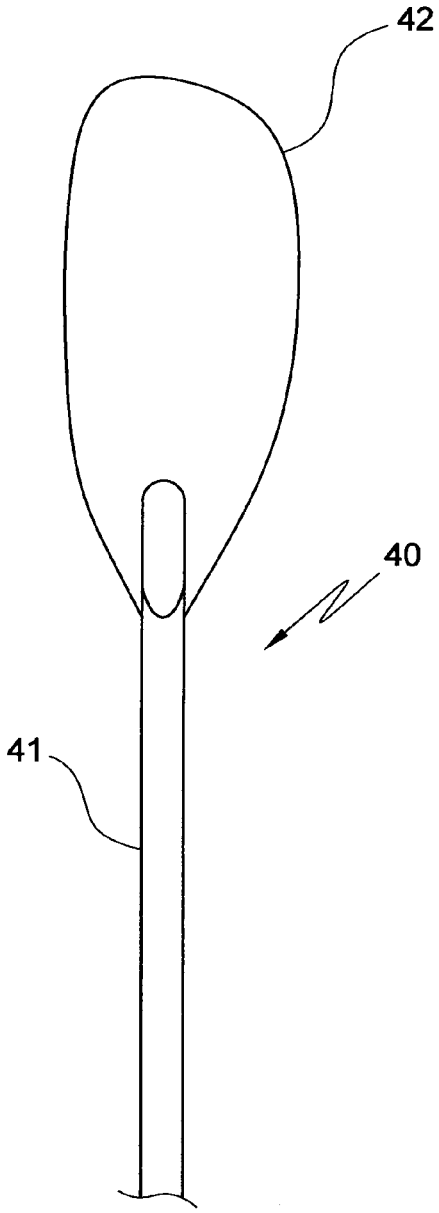
FIGS. 10*a* and 10*b* depict plan and side elevational views of a kayak paddle.
Figure 10B:
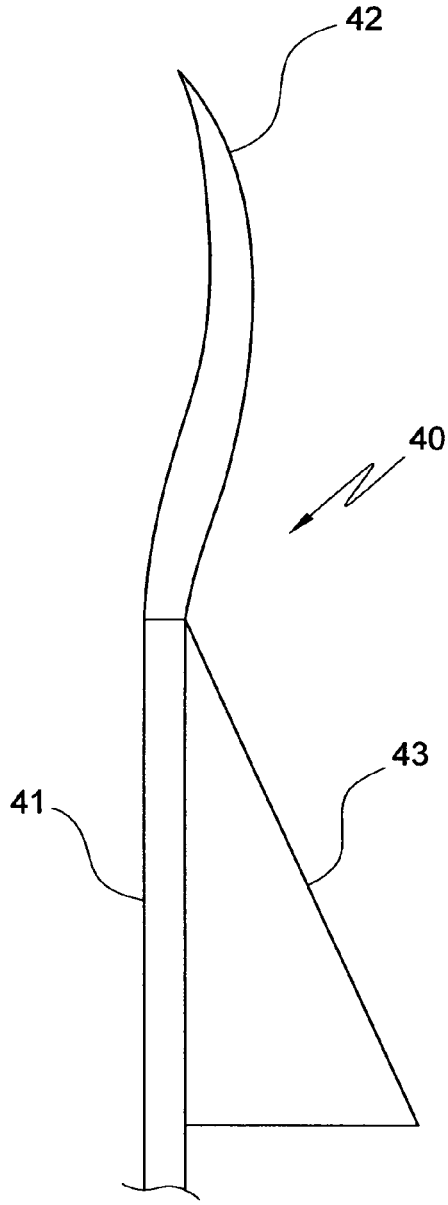
Figure 11:
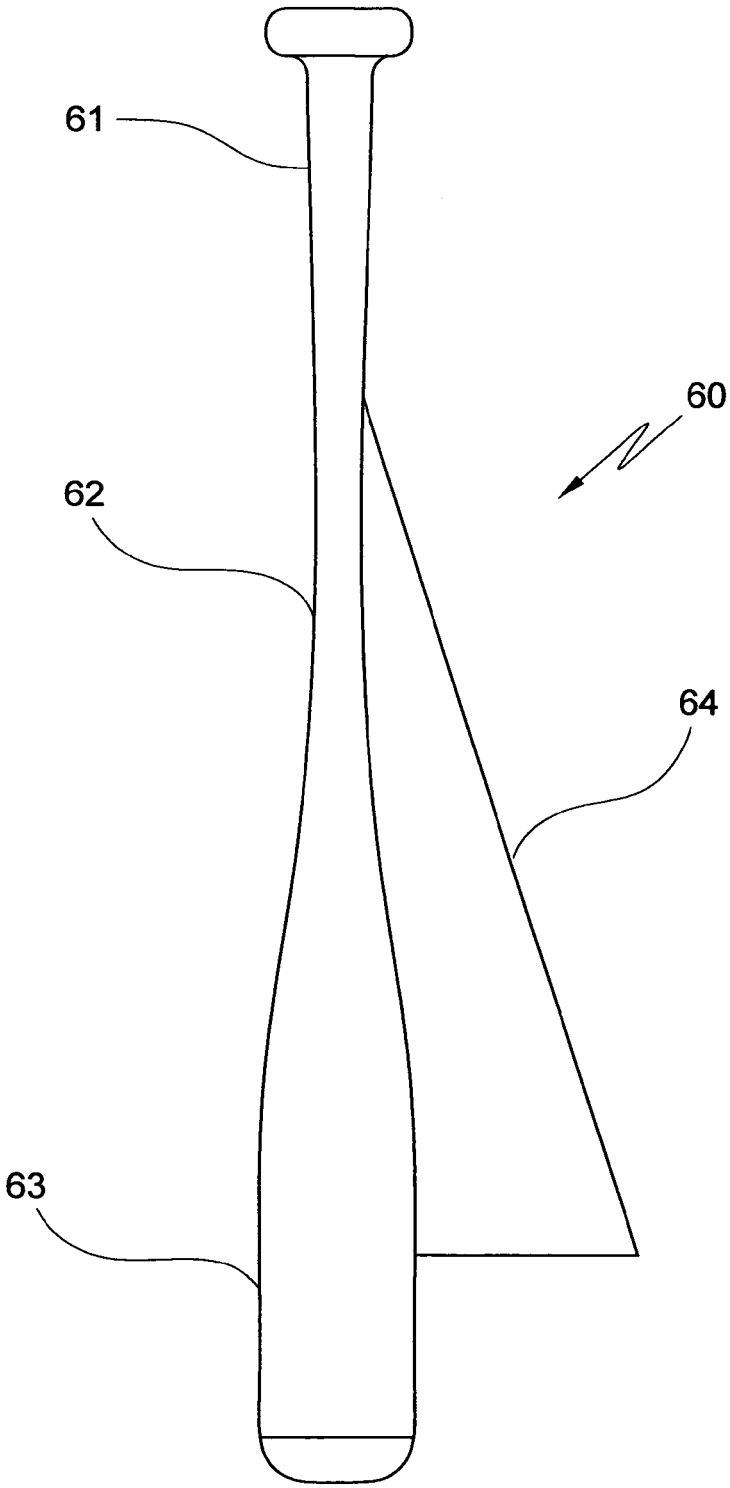
FIG. 11 is a side elevational view of a baseball bat.

Whilst the present application has described a particular application to a golf club (in FIGS. 1-9), it will be appreciated that implements other than golf clubs can have the features defined herein, including implements used in sporting and non-sporting endeavours whereby an apparatus is swung by a user at speed. In this regard, implements such as paddles or oars used in canoes, kayaks, and rowing boats, such as single and double sculls, can have the features defined herein with an aim being to reduce turbulence associated with use therewith. Such devices still have a grip region, a shaft and a head (in the form of a blade). As an example only, FIGS. 10*a* and 10*b* depict a kayak paddle 40 having a shaft 41 and a blade 42. In this embodiment, the shaft 41 also has a fairing 43 mounted thereon adjacent the blade 42. It will be appreciated a similar fairing could be provided at the other end of the paddle 40 adjacent the other blade. Other possible implements include baseball bats (such as depicted generally as 60 in FIG. 11). Here again, the bat 60 has a gripping region 61, a shaft 62, a head 63 and is depicted with one example of a fairing 64. Other sporting implements such as cricket bats, tennis racquets, table tennis paddles, and other such sporting equipment where control and speed of the equipment is fundamental in optimising sporting performance could have one, some or all of the features described herein with reference to the golf club. It could be used on tools that need to be swung, including hammers. While FIGS. 10*a* to 11 depict integral fairings, the fairings could be attachable in a manner such as is depicted in FIG. 3 with respect to the golf club. The fairing used on these other sporting implements or tools could have any combination of the features as described herein with reference to the golf club. These other sporting implements and tools can also be modified, where applicable to have a shaft having the features defined herein with reference to the golf club. Still further, the other sporting implements (e.g.

their shafts and heads) and the fairings mounted thereto can have the surface treatment as described herein.

It will be appreciated by persons skilled in the art that numerous variations and/or modifications may be made to what is shown in the specific embodiments without departing from the scope as broadly described. The present embodiments are, therefore, to be considered in all respects as illustrative and not restrictive.

The invention claimed is:

1. An apparatus for a golf club or other implement having a grip region and which is moved in use, the apparatus comprising:

a fairing, the fairing being attachable to a shaft of the golf club or implement to reduce drag associated with said shaft during a swing motion of the club or movement of the implement, and a plurality of discrete attachment members slidably mounted to the fairing at spaced apart positions of the fairing, the attachment members configured to attach the fairing to the shaft, wherein on attachment the fairing extends along a portion of the shaft from a location proximal an end of the club or implement that is distal the grip region where the club or implement is normally held towards the grip region.

2. The fairing of claim 1, wherein the fairing is non-removably attached to the shaft.

3. The fairing of claim 1, wherein the fairing is removably attachable to the shaft.

4. The fairing of claim 1, wherein the fairing is attachable to the shaft adjacent the head.

5. The fairing of claim 1, wherein the fairing is attachable to the shaft by a swivel mechanism, such that the fairing is rotatably movable relative to the shaft.

6. The fairing of claim 5, wherein once the fairing is moved to a desired position the fairing can be locked in that position.

7. The fairing of claim 1, wherein the fairing comprises a body that is in the form of an aerofoil.

8. The fairing of claim 1, wherein the fairing has one or more of holes, orifices or indentations provided therein which generate a sound as air passes therethrough or thereover.

9. A golf club or implement comprising:

a grip region;

a head;

a shaft connecting the grip region to the head;

a fairing attached to the shaft to reduce drag associated with said shaft during a swing motion of the club or movement of the implement, wherein the fairing extends along a portion of the shaft from a location proximal the head of the club or implement towards the grip region; and a plurality of attachment members attaching the fairing to the shaft, wherein the attachment members are slidably mounted to the fairing and the attachment members are attached to the shaft at respective attachment locations along the portion of the shaft, the attachment locations being spaced apart.

10. The golf club or implement of claim 9, wherein the shaft has a region of greater cross-sectional width or diameter relative to the remainder of the shaft.

11. The golf club or implement of claim 9, wherein a portion, a majority or all of the shaft is in the form of an aerofoil.

12. The golf club or implement of claim 9, wherein at least a portion of the shaft, head and/or fairing has a surface treatment that modifies the airflow over at least that portion.

13. The golf club or implement of claim 12, wherein the surface treatment comprises a dimpling formed in the surface of said portion.

14. The golf club or implement of claim 9, wherein an upper surface of the head provides at least one airflow path that is shorter than at least one airflow path over a lower surface of the head.

15. The golf club of claim 9, wherein the fairing is attached to the shaft adjacent the head and extends along the shaft away from the head for a length less than half the length of the shaft.

16. The golf club of claim 15, wherein the fairing extends along the shaft from the head for a length about a third of the length of the shaft or less.

17. The golf club of claim 9, wherein the fairing has a maximum thickness that is substantially the same as, or slightly less than the diameter of the shaft.

18. The golf club of claim 9, wherein the fairing is spaced from the shaft.

19. The golf club of claim 9, wherein the width of the fairing is such that it extends backwardly from the shaft farther than the head of the club.

20. The golf club of claim 9, wherein the fairing decreases in width from its lower end to an upper end that is distal the head.

21. The golf club of claim 20, wherein the width of the fairing tapers over some or all of the length of the fairing from its lower end to an upper end that is distal the head.

22. The golf club of claim 9, wherein the fairing is configured to be movable relative to the shaft such that during the swing motion of the club the fairing is free to move relative to the shaft.

23. The golf club of claim 9, wherein the fairing is configured to be movable relative to the shaft between at least two positions.

24. The golf club of claim 9, wherein the fairing comprises a body that in cross-section is wing or blade-shaped.

25. The golf club or implement of claim 9, wherein the implement is: a paddle, an oar, a baseball bat, a cricket bat, a tennis racquet, a table tennis paddle, or a hammer.

26. The golf club or implement of claim 9, wherein the attachment locations are equidistant apart.

27. The golf club or implement of claim 9, wherein the attachment locations are non-equidistant apart.

28. The golf club or implement of claim 9, wherein one or more of the attachment member extends circumferentially around the shaft at the respective attachment locations.

29. The gold club or implement of claim 9, wherein the attachment members are slidably mounted to the fairing by extending through holes located in the fairing.

30. A golf club or implement comprising:

a grip region;

a head;

a shaft connecting the grip region to the head;

a drag reduction means attached to the shaft to reduce drag associated with said shaft during a swing motion of the club or movement of the implement, wherein the drag reduction means extends along, a portion of the shaft from a location proximal the head of the club or implement towards the grip region; and a plurality of spaced apart attachment members attaching the drag reduction means to spaced apart attachment locations along the portion of the shaft, wherein the drag reduction means is slidable relative to the shaft at the respective attachment locations during a swing motion of the club or movement of the implement.

31. The golf club or implement of claim 30, wherein the drag reductions means comprises a fairing.

* * * * *